US006856784B2

(12) United States Patent
Pirwitz

(10) Patent No.: US 6,856,784 B2
(45) Date of Patent: Feb. 15, 2005

(54) COMPACT BELT FUSER APPARATUS WITH FLOATING IDLER ROLLERS SUPPORTED BY BELT

(75) Inventor: Robert G. Pirwitz, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 2 days.

(21) Appl. No.: 10/427,079

(22) Filed: Apr. 30, 2003

(65) Prior Publication Data

US 2004/0042829 A1 Mar. 4, 2004

Related U.S. Application Data

(60) Provisional application No. 60/407,216, filed on Aug. 29, 2002.

(51) Int. Cl.[7] ..... G03G 15/20

(52) U.S. Cl. ..... 399/329; 219/216

(58) Field of Search ..... 399/320, 321, 399/328, 329, 330, 331; 219/216

(56) References Cited

U.S. PATENT DOCUMENTS 5,099,288 A * 3/1992 Britto et al. ..... 399/320
5,250,998 A 10/1993 Ueda et al.
5,349,424 A * 9/1994 Dalal et al. ..... 399/329
5,359,401 A * 10/1994 Uehara et al. ..... 399/329
5,465,146 A 11/1995 Higashi et al.
6,321,061 B1 * 11/2001 Sonobe et al. ..... 399/329
6,496,666 B2 * 12/2002 Hayashi et al. ..... 399/329
6,498,911 B2 * 12/2002 Hiroki et al. ..... 399/329

FOREIGN PATENT DOCUMENTS

EP 0 302 884 B1 8/1994

* cited by examiner

*Primary Examiner*—William J. Royer
(74) *Attorney, Agent, or Firm*—David E. Henn; Joseph M. Young

(57) ABSTRACT

A belt fuser includes fuser and tension rollers rotatably supported in a frame. A belt reeved over the fuser and tension rollers holds at least two idler rollers in place and forms a nip with the fuser roller. The tension roller is connected to a tension control mechanism that applies, through the tension roller, a tension force in the belt and a normal force against the fuser roller throughout the nip. Because the belt holds the idler rollers in place, they can be of low-cost, light-weight, compact construction and require no additional support. Fusing nip length, dwell time, and thermal efficiency are greatly improved over two roll fusers, and the fusing temperature can be significantly reduced as a result. The belt fuser is more compact than previous belt fusers, occupying only slightly more space than conventional two roll fusers.

32 Claims, 5 Drawing Sheets

COMPACT BELT FUSER APPARATUS WITH FLOATING IDLER ROLLERS SUPPORTED BY BELT

This application is based on Provisional Patent Application No. 60/407,216, filed Aug. 29, 2002.

FIELD OF THE INVENTION

This invention relates generally to marking machines in which a fuser assembly or apparatus is used, such as electrostatographic reproduction machines. More particularly, the invention relates to a compact fusing apparatus for use in such a machine for increasing fusing dwell time and fusing thermal efficiency.

BACKGROUND AND SUMMARY

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roller or to a latent image on the photoconductive member. The toner attracted to a donor roller is then deposited on a latent electrostatic images on a charge retentive surface which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat and pressure, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rollers with the toner image contacting the heated fuser roller to thereby effect heating of the toner images within the nip. In a conventional two roll fuser one of the rolls is typically provided with a layer or layers that are deformable by a harder opposing roller when the two rollers are pressure engaged. The length of the nip determines the dwell time or time that the toner particles remain in contact with the surface of the heated roller.

Roller fusers work very well for fusing images at low speeds since the required process conditions such as temperature, pressure, and dwell can easily be achieved. When process speeds approach 100 pages per minute (ppm) roller fusing performance starts to falter. At such higher speeds, dwell must remain constant which necessitates an increase in nip width. Increasing nip width can be accomplished most readily by either increasing the roller rubber thickness and/or the outside diameter of the rollers. Each of these solutions reach their limit at about 100 ppm. Specifically, the rubber thickness and durometer (softness) are limited by the thermal and physical properties of the material. The roller size becomes a critical issue for reasons of space, weight, cost, and stripping.

Belt fusers, such as those disclosed in U.S. Pat. Nos. 5,250,998 and 5,465,146, are a type of toner image fixing device in which an endless belt is looped around a heating roller, a conveyance roller, and a pressure roller. The pressure roller presses a sheet having a toner image onto the heating roller with the endless belt intervening between the pressure roller and the heating roller. The fixing temperature for the toner image is controlled on the basis of the temperature of the heating roller detected by a sensor, such as a sensor in the loop of the belt and in contact with the heating roller. A first nip region is formed on a pressing portion located between the heating roller and the fixing roller. A second nip region is formed between the belt and the fixing roller, continuing from the first nip region but without contacting the heating roller. The disclosures of U.S. Pat. Nos. 5,250,998 and 5,465,146 are incorporated by reference.

Most belt fusers, however, take significantly more space than more conventional roller fusers. Thus, marking machines, such as electrostatographic reproduction machines, incorporating belt fusers must have larger housings, which is undesirable. Therefore, there is a need for more compact belt fusers.

Embodiments comprise a belt fuser with elongated fusing nip and compact overall size, primarily for use in marking machines, such as a reproduction machine. The compact long nip width fusing apparatus includes, in embodiments, a rotatable fuser roller about which a fuser belt is reeved to form the fusing nip, the tension roller being acted upon by an adjustable or constant force mechanism to engage and place tension on the belt. The belt fuser also includes floating idler rollers about which the belt is reeved. The resulting belt fuser has a longer nip and dwell time than roller fusers, better thermal efficiency and lower fusing temperature than roller fusers, but occupies only slightly more space than a conventional roller fuser.

DETAILED DESCRIPTION

Figure 1:
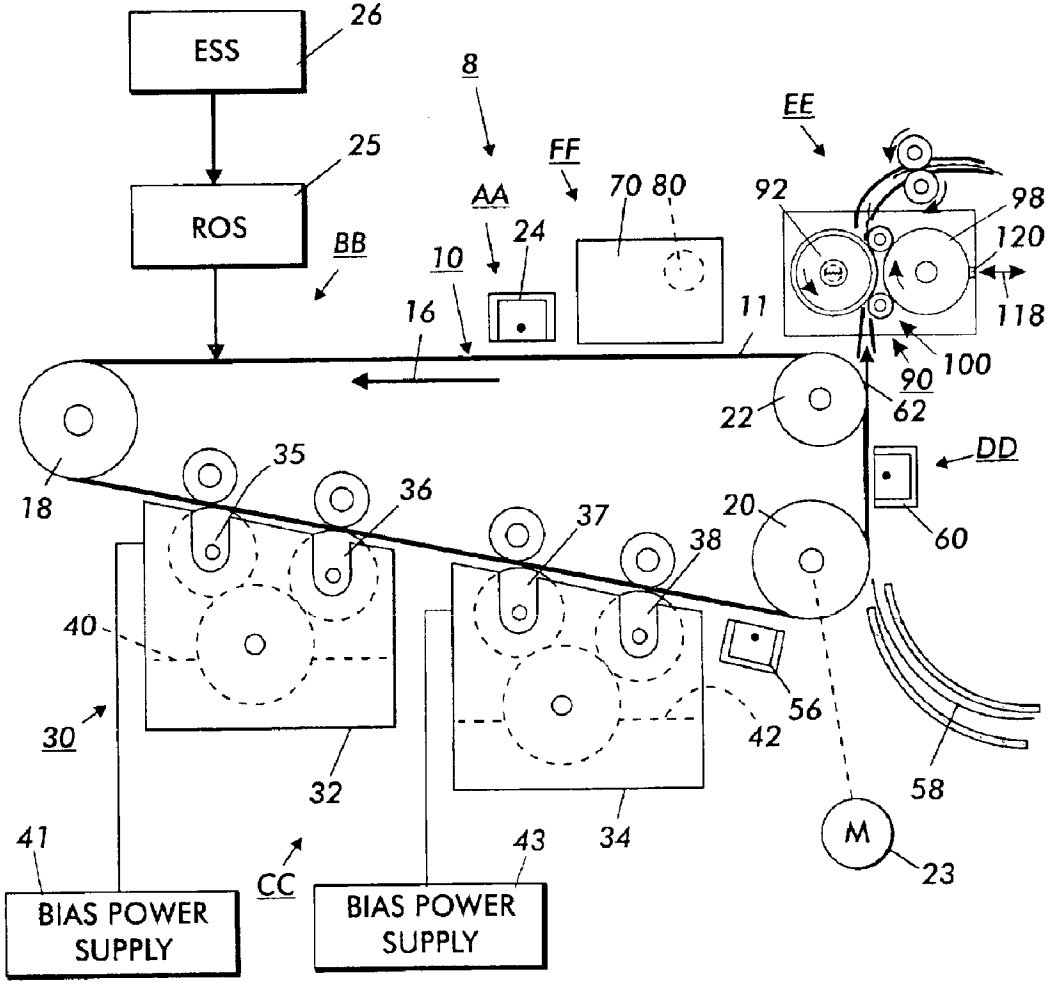
FIG. 1 is a schematic illustration of an electrostatographic reproduction machine incorporating the fusing apparatus of embodiments.
Figure 2:
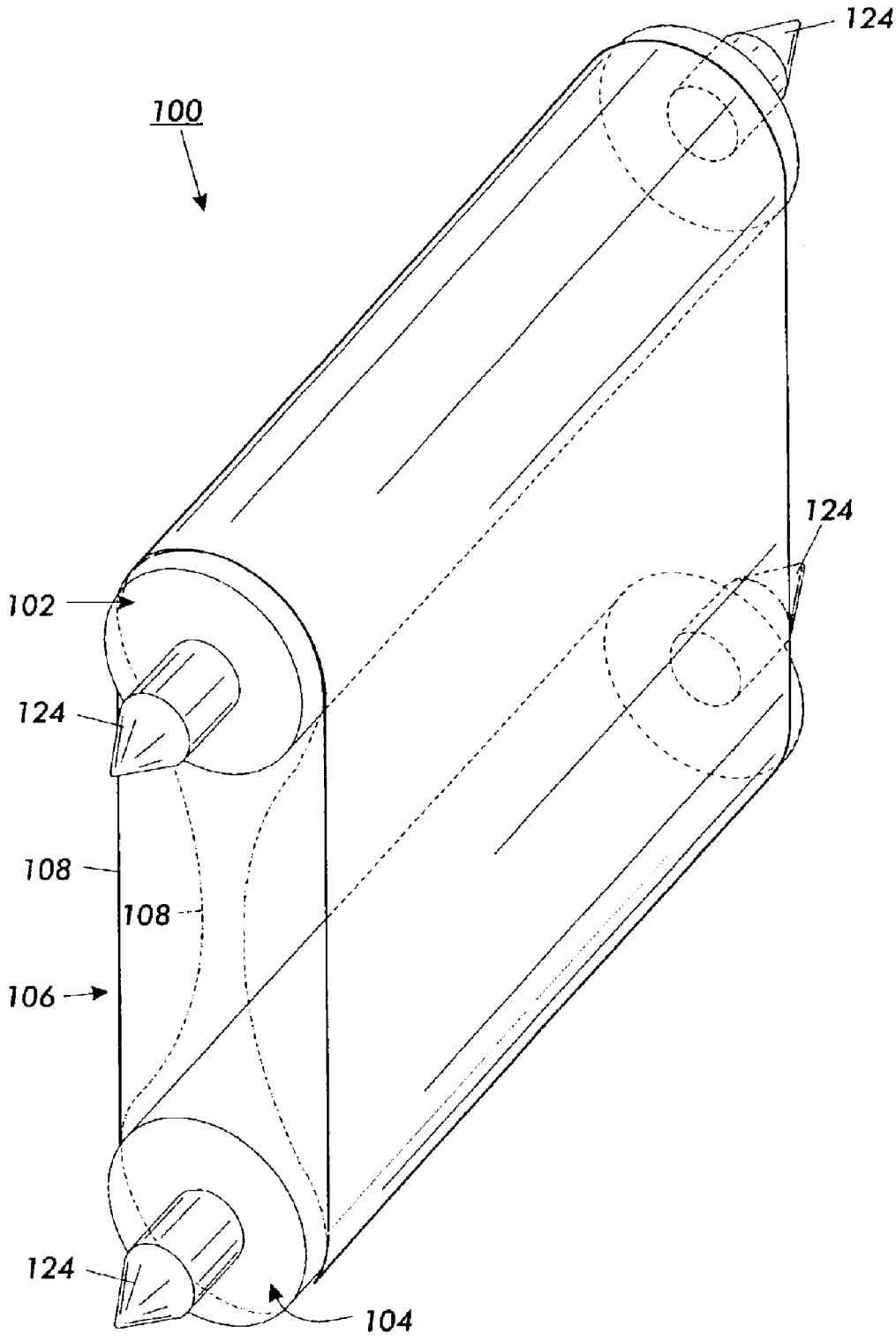
FIG. 2 is a perspective representation of the nip width converting mechanism of the machine of FIG. 1.

While the present invention will be described in connection with embodiments thereof, the description is not intended to limit the invention to those embodiments. For a general understanding of the features of the present invention, reference is made to the drawings, in which like reference numerals have been used throughout to identify identical elements.

Referring now to FIG. 1, the various processing stations employed in an electrostatographic reproduction machine are illustrated to provide an example of a marking machine in which embodiments can be employed.

As illustrated, an electrostatographic reproduction machine 8, in which the present invention finds advantageous use, utilizes a charge retentive image bearing member in the form of a photoconductive belt 10 consisting of a photoconductive surface 11 and an electrically conductive, light transmissive substrate. The belt 10 is mounted for movement past a series of electrostatographic process stations including a charging station AA, an exposure station BB, developer stations CC, transfer station DD, fusing station EE and cleaning station FF. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Roller 20 is coupled to motor 23 by suitable means such as a belt drive. Motor 23 rotates roller 20 to advance belt 10 in the direction of arrow 16.

As can be seen by further reference to FIG. 1, initially successive portions of belt 10 pass through charging station AA. At charging station AA, a corona discharge device such as a scorotron, corotron or dicorotron indicated generally by the reference numeral 24, charges the belt 10 to a selectively high uniform positive or negative potential. Any suitable control, well known in the art, may be employed for controlling the corona discharge device 24. Next, the charged portions of the photoreceptor surface are advanced through exposure station BB. At exposure station BB, the uniformly charged photoreceptor or charge retentive surface 10 is exposed to a laser based input and/or output scanning device 25 which, as controlled by controller or ESS 26, causes the charge retentive surface to be discharged in accordance with the output from the scanning device. The ESS 26, for example, is the main multi-tasking processor for operating and controlling all of the other machine subsystems and printing operations, including aspects of the present invention. The scanning device can be, for example, a three level laser Raster Output Scanner (ROS). The photoreceptor then contains both charged-area images and discharged-area images.

At development station CC, a development system, indicated generally by the reference numeral 30, advances developer materials into contact with the electrostatic latent images, and develops the image. The development system 30, as shown, can comprise first and second developer apparatuses 32 and 34, that can take any suitable form as is known in the art, so long as they advance developer material 40, 42 into contact with the photoreceptor for developing the discharged-area images. The developer material 40, by way of example, can include negatively charged color toner, and the developer material 42 can include, for example, a black toner. Electrical biasing is accomplished via power supply 41, 43 electrically connected to developer apparatus 32, 34. A DC bias is applied to the rollers 35, 36, 37, 38 via the power supply 41, 43.

Because the composite image developed on the photoreceptor consists of both positive and negative toner, a pretransfer corona discharge member 56 is provided to condition the toner for effective transfer to a substrate using corona discharge of a desired polarity, either negative or positive.

Sheets of substrate or support material 58, such as paper, are advanced to transfer station DD from a supply tray, not shown. Sheets are fed from the tray by a sheet feeder, also not shown, and advanced to transfer station DD through a corona charging device 60. After transfer, the sheet continues to move in the direction of arrow 62 towards fusing station EE.

Figure 3:
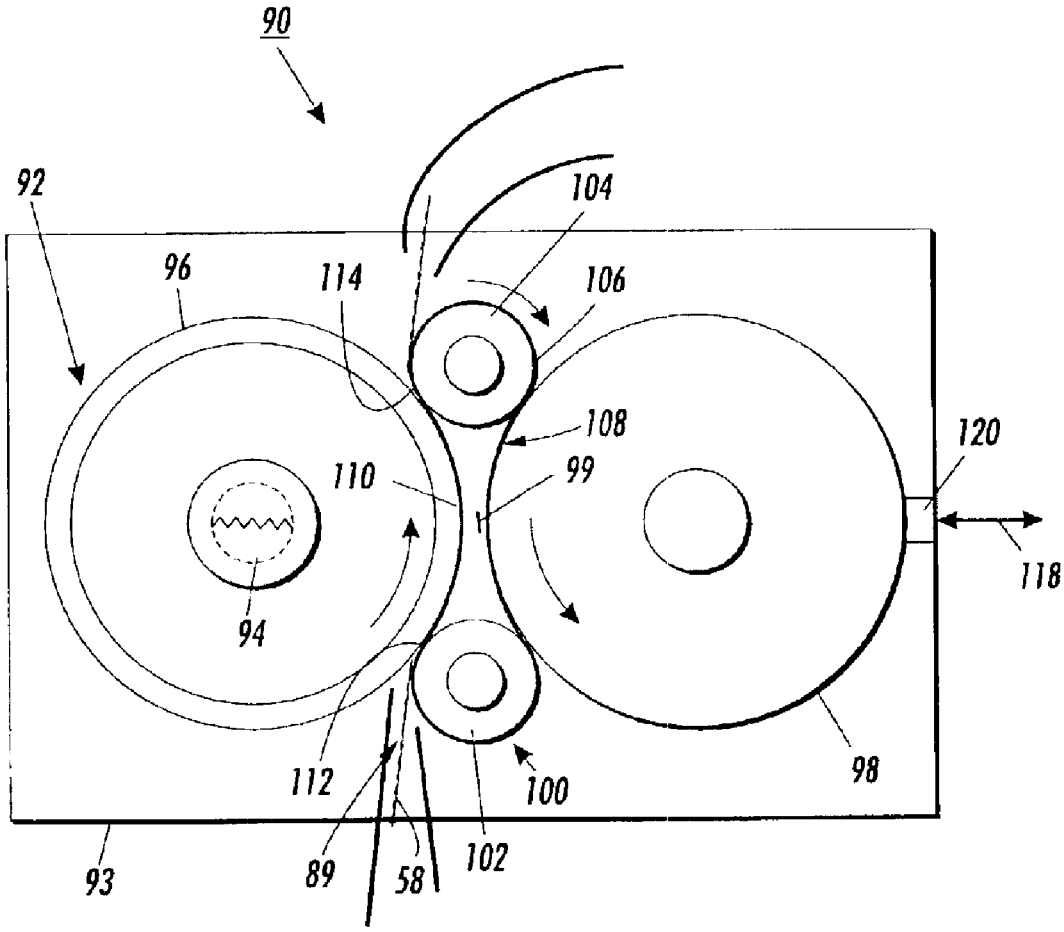
FIG. 3 is an end view schematic of the fusing apparatus of FIG. 1 in accordance with embodiments
Figure 4:
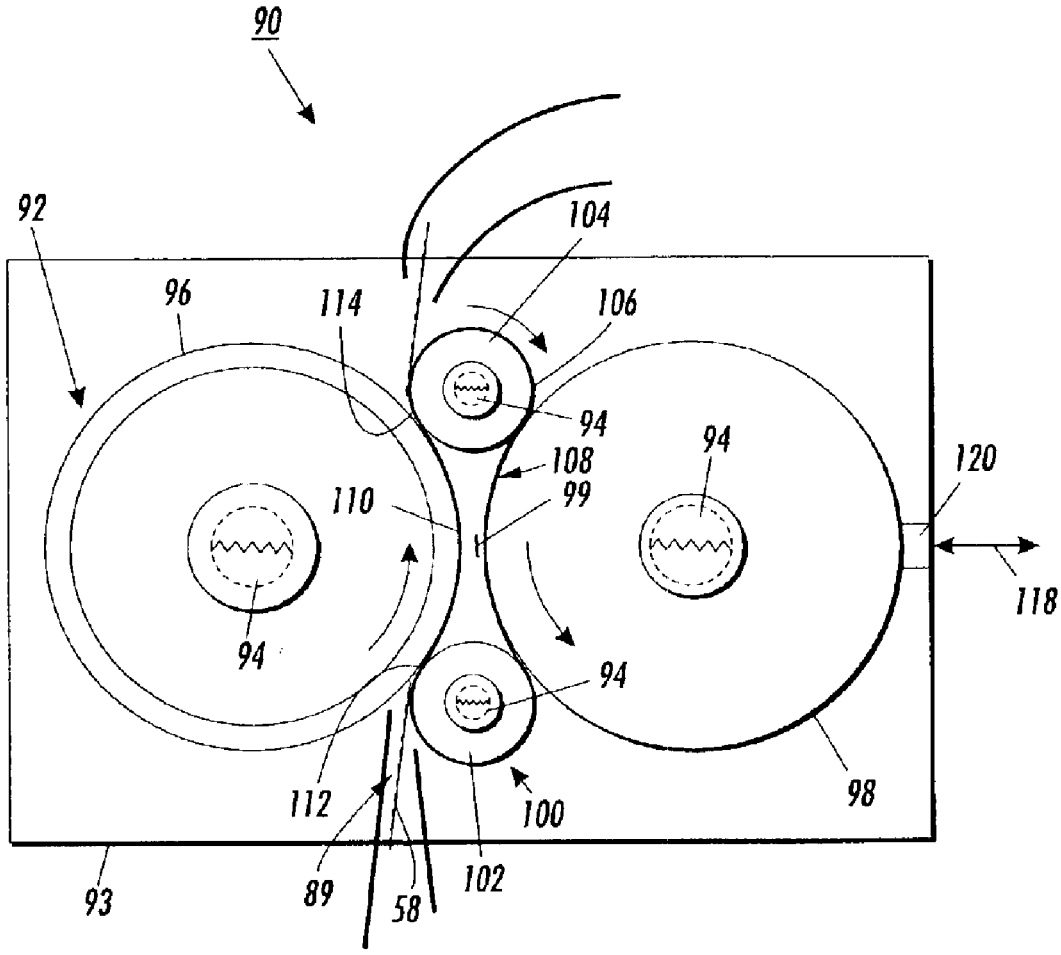
FIG. 4 is an end view schematic of a variation of the fusing apparatus of FIG. 1 in accordance with embodiments.
Figure 5:
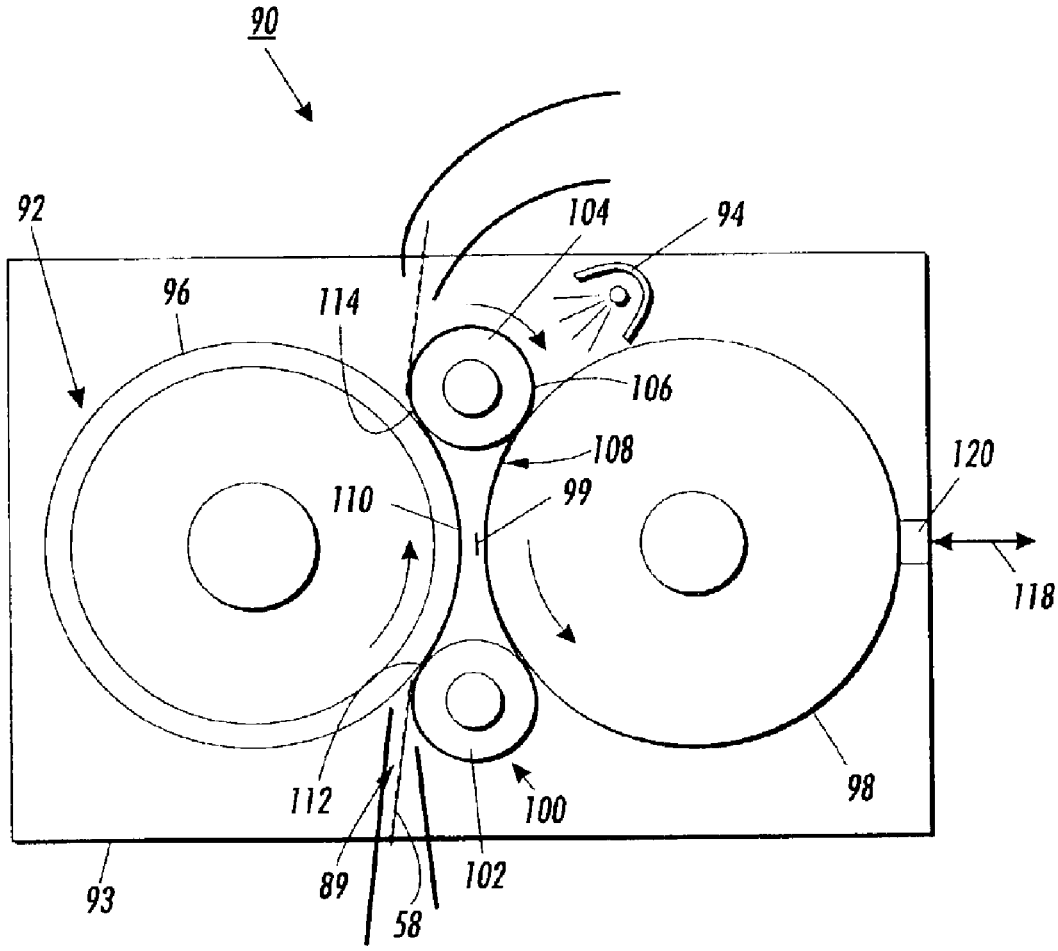
FIG. 5 is an end view schematic of a variation of the fusing apparatus of FIG. 1 in accordance with embodiments.

As illustrated, fusing station EE includes a compact belt fusing apparatus 90 in accordance with embodiments. As illustrated, the fusing apparatus 90 includes a rotatable fuser roller 92. The fuser roller 92 can be heated, for example, by a heating device 94. The heating device 94 is shown as an internal lamp, but can also be an external heater directed at the roller 92 or at the belt 10. Additionally, internal heating devices 94 can be placed in one or more other rollers of the apparatus, as seen in FIG. 3. The heating device 94 elevates the temperatures of the surface 96 of the fuser roller to a suitable toner fusing temperature. The fusing apparatus 90 also includes a rotatable tension roller 98 that is biased by tension control mechanism, which can take the form of an adjustable force mechanism, such as a linear actuator. In embodiments, the adjustable force mechanism is replaced with a simple, constant force mechanism, such as a spring, that pushes the tension roller toward the fuser roller.

As mentioned above, the compact fusing apparatus 90 increases fusing dwell time and fusing thermal efficiency relative to roller nip dwell time and fusing thermal efficiency as a result of its use of the belt and idler roller configuration. Referring now to FIGS. 2–5, and particularly FIGS. 2 and 3, the belt fuser includes idler rollers 102, 104 on the entrance and exit sides 112, 114 of the fusing nip 110. The idler rollers 102, 104 can comprise extruded aluminum member or another suitable article of manufacture. As further shown, an endless belt member 106, a fusing belt, is reeved over the idler rollers 102, 104, thus forming a deflectable or pinchable closed loop 108 about the rollers 102, 104, as seen in FIGS. 2–5. The fusing belt 106 is also reeved over or impinged by the rotatable fuser roller 92 and the biased rotatable tension roller 98. Advantageously, the closed loop 108 when pinched as such forms a long width fusing nip 110 against the rotatable fuser roller 92. The long fusing nip 110 that results has increased fusing dwell time and fusing thermal efficiency relative to the same from a conventional roller nip.

A particular advantage of the compact fusing apparatus 90 is that the idler rollers 102, 104 are supported and held in place by the closed loop 108 and the interaction of the belt 106 and the tension and fuser rollers 98, 92. This eliminates the need for radial bearings or bushings or any other similar support for the idler rollers, resulting in significant cost savings. The resulting long width fusing nip 10 includes two comparatively high nip pressure areas, comprising an entrance area 112 into the long width fusing nip, and an exit area 114 thereof. As shown, the first high nip pressure area 112 at the entrance into the long width fusing nip is created by the fuser roller 92 pinching a portion of one leg of the closed loop 108 against the idler roller 102. Similarly, the second high nip pressure area 114 is created by the fuser roller 92 pinching a portion of one leg of the closed loop 108 against the idler roller 104.

To recapitulate, the fusing apparatus 90 utilizes a unique floating idler rollers 102, 104 held in position solely by a closed loop 108 of a belt member 106. The idler rollers 102, 104 do not require any conventional radial bearings or positioning mechanisms as a result of the support of the belt 106. Because there are no bending moments applied to the idler rollers 102, 104, it can be of low cost, small diameter, thin wall, low mass construction. The tension roller 98 can be used to adjust tension in the belt 106 by virtue of an adjustable force mechanism, typically a mechanical spring, to which it is connected. This allows for a simple design that is much more compact, thermally efficient, and lower cost when compared to other belt fusers having a similar long width fusing nip. As pointed out above, the pressure profile of the long width fusing nip 110 of embodiments is also unique in that the highest pressure areas (two of them) can be at the nip entrance area 112, and at nip exit area 114.

Still referring to FIGS. 1–5, the fuser roller 92 preferably is the drive roller and can be mounted in a fixed position in a suitable frame 93 through a pair of end bushings (not shown). The tension roller 98 can also be mounted in the frame 93, but is typically movable into and away from the fuser roller 92 (arrow 118), and is typically loadable with a force F as by a tension control mechanism 120, such as a spring or an actuator, towards the fuser roller 92. Nip load and belt tension are thus determined by the load or force F applied to the tension roller 98. Because the floating idler rollers 102, 104 are held in position solely by the closed loop 108 of the belt member 106, they do not need conventional radial bearings or positioning mechanisms. Rather, the only additional support the idler rollers 102, 104 might require is some form of thrust bushing 124 at each end thereof for locating them laterally.

In operation, the copy medium 58 with an unfused toner image 89 on the top side as shown, enters the long width fusing nip 110 through the entrance area 112, and exits the nip 110 through the exit area 114. The high pressure area nip entrance will advantageously minimize cockle and other deformities on the incoming medium or sheet, and the high pressure area nip exit will act to improve fused image fixing onto the medium or sheet 58. As can be clearly seen, the toner image is in contact with the heated surface 96 of the fuser roller 92, and travels a much greater distance in such contact through the nip 110, as compared for example to travel through the roller nip of a two roll type fusing apparatus. As such, fusing dwell time, at a given travel speed, will be significantly greater through the long width nip 110 as compared to a roller nip.

In embodiments, the unfused toner image 89 can enter the fusing nip 110 oriented to engage the fuser belt 106. In such embodiments, the belt surface is the fusing surface and is heated by one or more heating devices 94. The heating devices 94 can be mounted inside and/or outside any or all of the rollers or belt. Such embodiments also enjoy the significantly improved dwell time and thermal efficiency and other advantages listed above as compared with two roll fusers.

Advantageously, the fusing apparatus 90 results in a compact belt fusing apparatus having a relatively small heated belt surface area as compared to other belt fusing systems. The compact structure and small heated surface area minimize thermal loss and require less energy for its operation. Fusing tests on similar such compact fusing apparatus were found to result an 84° F. reduction in a required fusing temperature as compared to a baseline or conventional heated and pressure roller fusing apparatus. Additionally, the belt member 106 is relatively short and hence costs relatively less, as do the idler rollers.

As can be seen, embodiments provide a compact long nip width fusing apparatus for use in a marking machine, such as a reproduction machine. While this invention has been described in conjunction with a particular embodiment thereof, unforeseeable alternatives, modifications and variations may arise to those skilled in the art. Accordingly, the present invention is intended to embrace all such alternatives, modifications and variations as fall within the spirit and broad scope of the appended claims.

What is claimed is:

1. A belt fuser comprising a tension roller arranged to control tension in a belt reeved over the tension roller, a fuser roller, and at least two floating idler rollers, ends of the tension roller and the fuser roller being supported by a frame.

2. The belt fuser of claim 1 wherein the at least two floating idler rollers over which the belt is reeved are supported against translation by the belt.

3. The belt fuser of claim 2 wherein the at least two floating idler rollers are supported by the belt and at least one of the fuser and tension rollers.

4. The belt fuser of claim 2 wherein the at least two floating idler rollers are supported against translation along respective axes of rotation by at least one respective thrust bushing.

5. The belt fuser of claim 1 wherein the tension roller is a driving roller.

6. The belt fuser of claim 1 wherein the fuser roller is a driving roller.

7. The belt fuser of claim 1 wherein the tension roller is engaged by a tension control mechanism.

8. The belt fuser of claim 7 wherein the tension control mechanism comprises a constant force mechanism.

9. The belt fuser of claim 8 wherein the constant force mechanism comprises a spring.

10. The belt fuser of claim 7 wherein the tension control mechanism comprises at least one actuator.

11. The belt fuser of claim 10 wherein the at least one actuator can be controlled independently so that the tension control mechanism can be used to steer the belt.

12. The belt fuser of claim 1 further comprising a fusing nip formed by engagement of a portion of the belt reeved over the fuser roller.

13. The belt fuser of claim 1 wherein at least one roller comprises an internal heat source.

14. A belt fuser comprising:

a fuser roller;

a tension roller;

a frame rotatably supporting the fuser and tension rollers, but substantially preventing translation of the fuser and tension rollers;

at least two floating idler rollers;

a belt reeved over the fuser, tension, and idler rollers;

a nip formed by the reeving of the belt over the fuser roller; and a tension control mechanism connected to the tension roller that applies, through the tension roller, a tension force in the belt and a normal force against the fuser roller throughout the nip.

15. The belt fuser of claim 14 wherein the fuser roller provides heat to the nip from an internal heat source.

16. The belt fuser of claim 15 wherein the internal heat source is a radiant heater lamp.

17. The belt fuser of claim 14 wherein the belt is heated and a surface of the belt reeved over the fuser roller is the fusing surface.

18. The belt fuser of claim 17 wherein the belt is heated by a heat source external to the rollers and the belt.

19. The belt fuser of claim 18 wherein the heat source is a radiant heater lamp directed at the belt.

20. The belt fuser of claim 14 wherein heat is provided via at least one respective heating element in at least one of the fuser, tension, and idler rollers.

21. The belt fuser of claim 20 wherein all of the rollers include a heating element.

22. The belt fuser of claim 14 wherein at least one of the rollers is directly driven.

23. The belt fuser of claim 22 wherein all of the rollers are directly driven.

24. A relatively low-temperature fusing method comprising:

providing a fusing belt;

providing a fuser roller;

providing a tension roller;

providing at least two idler rollers;

providing a force on the tension roller to allow belt tension adjustment;

reeving the fusing belt around the fuser, tension, and idler rollers;

ensuring that the fusing belt engages a substantial portion of a surface of the fuser roller to create an elongated fusing nip; and providing a heat source to heat the elongated fusing nip to a lower temperature than a conventional roller-to-roller fusing nip as a result of increased fusing dwell time and fusing thermal efficiency of the elongated fusing nip.

25. The method of claim 24 wherein providing a force includes providing an adjustable force by connecting at least one actuator to the tension roller.

26. The method of claim 25 further comprising connecting a controller to the at least one actuator, the controller ensuring adequate force is exerted by the at least one actuator.

27. The method of claim 24 wherein providing a force includes connecting a spring to the tension roller.

28. The method of claim 24 wherein providing a heat source comprises providing an internal heater in at least one of the rollers.

29. The method of claim 24 wherein providing a heat source comprises providing a heater external to the fuser roller, directing the heater at the fusing belt, heating the fusing belt with the heat source, and using a surface of the fusing belt engaging a surface of the fuser roller as the fusing surface.

30. The method of claim 24 further comprising providing a high fusing nip entrance pressure.

31. The method of claim 24 further comprising providing the at least two idler rollers rotatably supported and maintained in place by the fusing belt.

32. The method of claim 24 further comprising providing a high fusing nip exit pressure.

* * * * *